United States Patent [19]

LaConti et al.

[11] Patent Number: 4,749,452

[45] Date of Patent: Jun. 7, 1988

[54] MULTI-LAYER ELECTRODE MEMBRANE-ASSEMBLY AND ELECTROLYSIS PROCESS USING SAME

[75] Inventors: Anthony B. LaConti, Lynnfield; Thomas G. Coker, Lexington, both of Mass.

[73] Assignee: Oronzio de Nora Impianti Elettrochimici S.p.A., Milan, Italy

[21] Appl. No.: 336,112

[22] Filed: Dec. 30, 1981

[51] Int. Cl.[4] ..... C25B 1/14

[52] U.S. Cl. ..... 204/98; 204/128; 204/282; 204/283; 204/240 R

[58] Field of Search ..... 204/98, 128, 282, 283, 204/290 R

[56] References Cited

U.S. PATENT DOCUMENTS

| | | | |
|---|---|---|---|
| 3,242,059 | 3/1966 | Cottam | 204/98 |
| 3,791,872 | 2/1974 | Sturm | 252/425.3 |
| 4,104,197 | 8/1978 | Heffler | 252/425.3 |
| 4,224,121 | 9/1980 | Dempsey | 204/128 |
| 4,299,675 | 11/1981 | Korach | 204/128 |
| 4,301,218 | 11/1981 | Benczur | 204/290 R |
| 4,364,803 | 12/1982 | Nidola et al. | 204/30 |
| 4,666,574 | 5/1987 | Oda et al. | 204/98 |

*Primary Examiner*—R. L. Andrews

*Attorney, Agent, or Firm*—Pollock, Vande Sande & Priddy

[57] ABSTRACT

A unitary membrane-electrode assembly includes an electrode structure with multiple layers having different overvoltages for the desired electrochemical reaction. In the preferred arrangement the layer attached to the membrane has the higher overvoltage thereby preferentially locating the reaction zone a small but controlled distance away from the electrode membrane interface. In a NaCl brine electrolysis process the use of a dual layer electrode as the cathode is particularly useful because it eliminates formation of concentrated caustic at the membrane surface. As a result, back migration of $OH^-$ ions is reduced and cathodic current efficiency is increased.

13 Claims, No Drawings

MULTI-LAYER ELECTRODE MEMBRANE-ASSEMBLY AND ELECTROLYSIS PROCESS USING SAME

This invention relates to a unitary, membrane-electrode assembly useful in electrochemical cells. More particularly, it relates to an assembly utilizing a multi-layer electrode with varying catalytic activities to control location of the reaction zone, and also relates to electrolysis processes using such an assembly.

While the instant invention will be described principally in connection with the use of a dual layer electrode as a cathode in a brine electrolysis cell, the invention is obviously not limited thereto as it may be used as an anode and with feedstocks other than aqueous alkali metal halides (viz, NaCl, KCl, LiCl, NaBr, etc.) to produce caustic or other hydroxides. Other alkali metal solutions such as sodium or potasium sulfates, sodium hydroxide, may also be used. In fact, the instant invention is useful in any process or cell using an ionically dissociable liquid feedstock, i.e., a liquid electrolyte, in which it is desired to locate an electrochemical reaction zone away from a permselective membrane while attaching the electrode structure at which the reaction takes place to the membrane to form a unitary structure.

As used in the instant application:

The term "sulfonate" refers to ion-exchanging sulfonic acid functional groups or metal (preferably alkali metal) salts thereof; the term "carboxylate" refers to ion-exchanging carboxylic acid functional groups or metal (preferably alkali metal) salts thereof, while "phosphonate" refers to ion-exchanging phosphonic acid functional groups or metal (preferably alkali metal) salts thereof.

The term "membrane" refers to solid film structures useful in electrochemical cells, particularly, though not limited to, cells for the electrolysis of alkali-metal halides. The structure may be homogeneous as to its functional groups, i.e., all sulfonate, all carboxylate, etc. or it may have layers containing different functional groups with the layers formed by laminating (with or without support fabrics) or by chemical surface modification.

The use of perfluorocarbon ion selective membranes in chlor-alkali electrolysis and in other electrolysis processes is well known. One particularly effective form of such cells and processes is described in U.S. Pat. Nos. 4,224,121 and 4,210,501 assigned to General Electric Company, the assignee of the present application and illustrate the use of a unitary membrane-electrode assembly in which on or both electrodes are attached to and distributed over the surface of the membrane. One of the principal advantages of such as assembly is that it brings the chemical reaction zone toward the surface of the membrane thereby eliminating or minimizing membrane-electrode gaps and the Ir voltage drops associated with the liquid film and gaseous bubble formation in the gaps. Although cells and processes utilizing such unitary membrane-electrode assemblies are characterized by low cell voltages and good current efficiencies and are able to function with very low loadings (mg/cm) of the expensive catalytic materials, the thinness of the electrode, against which a current collector is pressed, may not cushion the pressure adequately so that distortion of or damage to the membrane may occur.

By moving the electrochemical reaction zone toward the surface of the membrane to which the electrode is attached, the caustic concentration at the membrane surface in such a chlor-alkali cell can be quite high. Concentrations of 40–45 weight % of caustic or higher are produced at the membrane surface although the bulk concentration is substantially lower. At such high local concentrations, back migration of the hydroxyl ion across the membrane and the resultant cathodic current inefficiencies, can be a problem even with membranes having excellent rejection characteristics. Furthermore, at concentration of 33% or more the membrane resistivity increases resulting in increased ir drop at the membrane layer in contact with the concentrated caustic.

Applicant has discovered that the caustic concentration at the membrane surface and back migration of hydroxyl ions can be substantially reduced and the cathodic current efficiency increased by moving the electro-chemical reaction zone a small but controlled distance away from the membrane without introducing excessive voltage drops due to liquid or gaseous films. To this end, a multi-layer is attached to the membrane with the layer away from the membrane having a lower overvoltage for the reaction than the layer adjacent to the membrane so that the reaction takes place in or at this electrode layer. By moving the reaction zone to the outermost layer, water moving through the membrane with the cations and water diffusing through the liquid pervious outer layer from the bulk catholyte dilutes caustic formed at the second layer and reduces the caustic concentration at the membrane. Hydrogen transport through the outer layer is in a direction such that evolved gases move toward the bulk liquid preventing formation of gaseous films or bubbles at the membrane surface. The reduction in membrane resistivity due to the much lower caustic concentration at the membrane surface more than compensates for any Ir drop due to any liquid in the inner layer through which the sodium ions must pass to get to the reaction zone where caustic is formed. Thus, in addition to improving the current efficiency, the cell voltage is maintained at low values so that very efficient electrolysis processes are realized.

Attaching a dual layer electrode to the membrane also has a cushoning effect for current collector pressure and protects the membrane against deformation or damage. It is thus possible to lower the quantity of catalytic material used in the low over-voltage layer since a greater latitude in contact pressure is possible without risking damage to the membrane.

It is, therefore, a principal objective of this invention to provide an improved chlor-alkali electrolysis process in which the electro-chemical reaction zone is spaced from a permselective membrane even though the electrode structure at which the reaction takes place is attached to the membrane.

A further objective of this invention is to provide an improved chlor-alkali electrolysis process with dual reaction zones at an electrode structure attached to an ion-transporting membrane.

Another objective of the invention is to provide a unitary membrane-electrode assembly with a multi-layer electrode attached to the membrane.

Further objectives and advantages of the invention will become apparent as the description thereof proceeds.

In accordance with the invention the unitary membrane-electrode assembly has a liquid and gas permeable dual layer electrode structure attached to the membrane surface. The inner layer attached to the membrane has a higher over voltage for the electrochemical reaction—evolution of hydrogen and production of caustic at the cathode in a chlor-alkali system—than the outer layer so that the reaction takes place principally at the outer layer. The inner layer preferably includes electronically conductive particles so that it also functions as a current distributor on the underside of the electrochemically active outer layer as well as a cushion, bubble barrier and electrolyte spacer.

The novel features which are believed to be characteristic of the invention are set forth with particularity in the appended claims. The invention itself, however, both as to its organization and method of operation, together with further objects and advantages thereof, may best be understood by referencing the following description:

The novel process and the novel unitary membrane-electrode assembly are preferably used in a brine electrolysis cell which is divided into anode and cathode chambers by the unitary membrane-electrode assembly. The novel dual layer electrode is attached to the side of the membrane facing the cathode chamber to locate the electrochemical reaction zone—i.e., the zone in which hydrogen ions are discharged to form hydrogen gas and sodium ions reacted to form caustic—away from the membrane by a distance equal at least to the thickness of the inner layer. A dual layer anode electrode may, if desired, be attached to the anode side of the membrane. Alternatively, a single layer anode electrode of the type shown in the aforesaid patents, may be attached to the other surface of the membrane. The anode electrode need not necessarily be attached to the membrane as a Dimensionally Stable Anode (DSA) comprising a titanium or other valve metal substrate covered with a catalytic layer of a platinum group metal or a platinum group metal oxide may be positioned against or adjacent to the membrane facing the anode chamber.

Current collectors in the form of nickel or stainless steel screens are positioned against the dual layer cathode and platinized niobium screens against the anode, whether single or dual layer. The current collectors are, in turn, connected to a power source to supply current to the cell. The cell also includes stainless steel cathode and titanium anode endplates and the membrane-electrode assembly is positioned between the endplates; using Teflon or other chemically resistant gaskets.

An aqueous solution of an alkali metal halide, such as brine, containing from 100 to 320 grams per liter, is introduced into the anode chamber, and chlorine and spent brine are removed from the chamber through suitable inlet and outlet conduits. Water or a dilute caustic solution is introduced into the cathode chamber and hydrogen and a concentrated 10–45 weight % solution of caustic, with 25–35 being preferred, is removed from the chamber through suitable inlet and outlet conduits.

The perfluorocarbon membrane typically is a copolymer of polytetrafluorethylene (PTFE) and a fluorinated vinyl compound such as polysulfonyl fluoride ethoxy vinyl ether. Pendant side chains containing sulfonate, carboxylate, phosphonate or other ion-exchanging functional groups are attached to the fluorocarbon backbone. The membranes are typically from 2–15 mils thick depending whether support fabrics are incorporated in the membrane.

The dual layer electrode has an inner layer which is directly attached to the membrane. The inner layer has a higher overvoltage for $H_2$/NaOH reactions than the outer layer which contains platinum group metal catalysts, Ni, Co, etc., in the form of blacks or particles although other low $H_2$ overvoltage catalyst may also be used.

The inner layer is preferably electronically conductive so that it not only moves the electrochemical reaction zone away from the membrane but it also acts as a current distributor-collector in that there is current flow from the screen current collector through the catalytic particles in the outer layer and then laterally to other particles in the outer layer.

By moving the reaction zone away from the membrane surface the amount of water at the membrane surface is increased and is constituted of the water pumped across the membrane with the sodium ions as well as water that diffuses through the electrode at which the action takes place to the inner electrode. This increases the amount of water present there and dilutes any caustic present at the surface of the membrane. The important fact is that the caustic concentration right at the interface of the membrane is substantially lower than concentrations known to be present when the caustic producing electrode is bonded directly to the membrane and the reaction takes place at the membrane.

Both layers may be bonded aggregates of the particles and particles of polymeric binder such as polytetrafluorethylene (PTFE).

If the inner layer is of a particulate nature, the particles may be of a metallic and electronically conductive material such as nickel; or of an electronically conductive and non-metallic material; such as carbon or graphite. Alternatively, caustic stable oxides, such as titanium oxide, nickel oxide, tin oxide, sulfides or semiconductors may also be utilized. It must be understood that the invention is not limited to the use of a porous particulate layers. Porous, electronically-conductive metallic and non-metallic layers, such as porous nickel sheets and porous graphite paper may also be used.

Nor need the inner layer be electronically conductive. Caustic stable, non-conductive polymers such as sulfones or perfluorcarbon polymers may be utilized. In such a case the inner layer is effective to move the electrochemical reaction zone away from the membrane surface and to cushion the membrane from current collector pressure but will not function as an electron current distribution path.

The thickness of the porous, layers is not critical and may vary. Thus it has been found that there is excellent electrode performance with the thickness of the catalytic outer layer ranging from $0.1–0.2\times10^{-2}$ cms while the inner layer may be from $0.3–0.5\times10^{-2}$ cms as measured by scanning electron microscope (SEM) at a hundred (100×) magnifications.

Also, the structure of the layers is such that the hydrogen gas transport characteristics of the outer layer cause hydrogen bubbles formed in the outer layer to flow toward the bulk electrolyte rather than into the inner layer where it may form a stagnant gas film. Higher hydrogen gas transport rates may be effected by controlling those structural characteristics of the electrode layer; viz, porosity, void volume, permeability, average pore diameter, etc. which will insure that there is a preferential direction of movement of hydrogen gas through the electrode towards the bulk electrolyte rather than toward the inner layer.

Each bonded aggregate layer is prepared by first mixing the particles with particles of a polytetrafluoroethylene binder with the weight percentage of the binder ranging from 5–45 weight percent. Suitable forms of the binder are those sold by E. I. DuPont deNemours Co., under its trade designations Teflon T-30 or T-7.

In one suitable fabricating technique, a mixture of metallic or non-metallic electronically conductive particles (for the first layer) or platinum group metal or other catalytic particles (for the outer layer) and Teflon binder particles are placed in a mold having the desired shape and dimensions of the electrode. The mixture is heated in the mold until it is sintered to form the bonded layer aggregates. The bonded structure is then placed on a thin, 2–15 mil, metallic foil which may be fabricated of Titanium, Tantalum, Niobium, Nickel, Stainless or Aluminum. The membrane is placed over the foil supported aggregate and heat and pressure is applied to attach the aggregate to one side of the membrane and the foil is then peeled off.

The mixture of particles need not be sintered to form a bonded aggregate prior to bonding to the membrane. In an alternative procedure the mixture in powder form is placed on the metallic foil and the membrane placed thereover. The application of heat and pressure bonds the particles to the membrane and to each other for form the unitary membrane-electrode assembly. The temperature, pressure and time parameters are not critical. The pressure may vary from 400–1000 psi. The temperature has an upper limit determined by the meltdown or decomposition temperature of the membrane, which for most perfluorocarbon membranes is between 400°–450° F. The lower end of the range is determined by that temperature at which adhesion becomes questionable; 250° F. seems to be the practical downside limit of the temperature range. The best temperature range is generally between 300° and 400° F. and preferably between 350° and 400°. The preferred operational conditions for bonding to the membrane are at 350° F. and 1000 psi for a period of two (2) minutes.

The duration of the heat and pressure cycle varies from 1–5 minutes and is most effective in the 2–3 minute range.

After the inner layer has been bonded to the membrane the foil is peeled off in the case of metals such as titanium, tantalum, nickel, aluminum, etc. as these are readily removed from the layer. In the case of an aluminum foil, which is relatively soft, so that the particles are sometimes partially embedded in the foil, the foil may be removed by dissolving the aluminum with sodium hydroxide and thereafter washing the bonded electrode layer with distilled water to remove any residual aluminum and sodium hydroxide. However, the removal by an aqueous solution of sodium hydroxide is not preferred since dissolution of the aluminum in sodium hydroxide may result in the impregnation or exchange of aluminum into the membrane.

After the first layer has been attached to the surface of the membrane, the outer electrochemically active layer is attached to the inner layer preferably by heat and pressure to form the dual layer electrode structure. The second layer is prepared in the manner described previously; that is, by first forming a molded aggregate, placing the molded aggregate on a metallic foil, placing the membrane and inner layer structure over the aggregate on the foil and applying heat and pressure thereby attaching the outer layer to the exposed surfce of the layer previously attached to the membrane.

The procedure is the same if the particles making up the outer layer of catalyst and binder are not preformed into a bonded aggregate. Thus, the mixture of particles is placed on a metallic foil. The surface of the inner high voltage layer attached to the membrane is placed over the powder mixture on the foil and heat and pressure is applied bonding the catalytic and binder particles to each other and to the outer surface of the inner layer to form a unitary membrane-dual layer electrode assembly.

Other precedures for attaching the second layer may also be utilized. For example, the dual layer structure may be preformed and the preformed structure attached to the membrane. It is also possible to form the dual layer structure in such a manner that the outer catalytic layer is not a bonded aggregate of catalytic and binder particles but is merely a layer of catalyst. In such case, the catalytic material may be deposited on the surface of the inner layer in a variety of ways as by electrolytic deposition, vapor deposition, sputtering, etc.

In an alternative multi-layer electrode construction, particularly one in which low loadings of the expensive catalytic material in the layer in which the electrochemical reaction is to take place is desired, a three layer structure may be utilized in which a gas and liquid permeable porous outer layer consists principally of electron conductive material which has a high hydrogen/caustic overvoltage. The outer layer is deposited over a central catalytic layer which has a low $H_2$/NaOH overvoltage, so that the outer layer acts principally as a current condutor for the catalytic central layer. Thus the electrode structure has three layers in which a high overvoltage layer, which may or may not be electronically conductive, is attached directly to the membrane, a second electronically conductive and catalytic layer with a low overvoltage for the electrochemical reaction is deposited over the inner layer and a third eletronically conductive abut non or low-catalytically active layer is attached to the middle layer. In such an arrangement, the outer current conductive layer is fabricated to have good transport characteristics for the bulk electrolyte in order to have good mass transport of the bulk electrolyte to the central catalytic layer located between the inner layer attached to the membrane and the outer current distributing layer.

It has also been discovered that the use of multi layer cathodes has the additional benefit, particularly when used with carboxylate membranes or membranes having carboxylate cathode rejection layers, of reducing transport or permeation of hydrogen gas across the membrane to the anode. To the extent membranes are subject to permeation of hydrogen, moving the reaction zone where hydrogen is produced away from the membrane surface minimizes hydrogen transport back across the membrane.

Use of the multi layer electrode as an anode is particularly beneficial in minimizing oxygen evolution due to back migration of the hydroxyl OH ions when used with acidified brine. By locating the catalytic platinum group metals away from the membrane surface, a neutralizing reaction can take place to form water with acidified brine right at the membrane high overvoltage interface before the hydroxyl ions reach the platinum catalyst and form oxygen.

The multi layer electrode is also very useful as an anode with those feedstocks, such as sodium sulfate, where both sodium and hydrogen ions are formed. By moving the reaction zone away it avoids high hydrogen cation concentrations at the membrane surface. As a result the sodium ions are preferentially transported to the cathode and sulfuric acid formed in the anode chamber.

To illustrate the innovative apsects of the instant invention, and to show details of the process for producing the unitary membrane-dual layer electrode assembly; as well as the performance of such an assembly in a chlor-alkali cell, the following examples are provided:

EXAMPLE 1

A membrane-electrode assembly was prepared using a 14 mil cloth supported laminate. The laminated membrane has a 2 mil thick perfluorocarbon layer with carboxylate functional groups laminated to a perfluorocarbon layer having sulfonate functional groups. A 3"×3" dual layer electrode structure was attached to the carboxylic layer in the following manner:

A mixture of 23 miligrams of Shawninigan Carbon (to provide a carbon loading of 1 mg/cm$^2$) and 35 weight % of DuPont T-7 PTFE particle was placed on a nickle foil. The carboxylic layer of the membrane was placed over the powder mixture on the foil and the layer attached to the foil by applying a pressure of 1000 psi at 350° F. for two (2) minutes and the foil peeled off.

A mixture of 69 miligrams of platinum black (to provide a 3 mg/cm$^2$ loading) and 15 weight % of DuPont T-30 PTFE particles was placed on a nickel foil. The membrane was placed over the mixture with the exposed surface of the inner carbon layer attached to the membrane contacting the mixture. Pressure of 1000 psi at 350° F. was applied for two (2) minutes. The foil was then peeled off leaving a dual layer electrode structure attached to the membrane.

The membrane electrode assembly was installed in cell #1 having a titanium anode and stainless steel cathode endplates separated by the membrane and Teflon gaskets to form anode and cathode chambers. A Dimensionally Stable Anode (DSA) was positioned against the membrane in the anode chamnber and a nickel screen against the catalytic outer layer of the dual layer cathode.

A control cell, cell #2, was constructed as described above which differed only in that the cathode electrode attached to the membrane had a single layer consisting of a bonded aggregate of 1 mg/cm$^2$ of carbon with 35 weight % of DuPont T-7 PTFE; i.e. the cathode was the same as the high overvoltage inner layer of the dual layer structure.

Both cells were operated with an aqueous anolyte solution containing 250 grams of NaCl per liter* and a catholyte feed of about 28–30 weight % aqueous NaOH catholyte. The performance of both cells was measured and the results were as follows:

TABLE I

| Operating Hours | Current Density (Amps/sq/ft. (ASF) (Amps/sq. decimeter) (A/dm$^2$) | T (°C.) | Cell Volts | NaOH (Bulk) (Wt. %) | Cathodic Current Efficiency % (C.E.) |
|---|---|---|---|---|---|
| CELL #1 WITH DUAL LAYER CATHODE: | | | | | |
| 162 | 304 ASF | 85 | 3.26 | 31.3 | 91 |
| 186 | 304 ASF | 78 | 3.23 | 30.3 | 88 |
| 258 | 304 ASF | 84 | 3.28 | 31.1 | 89 |
| 306 | 304 ASF | 81 | 3.26 | 30.6 | 91 |
| 354 | 304 ASF | 84 | 3.27 | 31.1 | 90 |
| 450 | 304 ASF | 77 | 3.35 | 32.5 | 94 |
| 522 | 304 ASF | 78 | 3.42 | 33.7 | 94 |
| 594 | 30 A/dm$^2$ | 75 | 3.30 | 32.5 | 98 |

TABLE I-continued

| Operating Hours | Current Density (Amps/sq/ft. (ASF) (Amps/sq. decimeter) (A/dm$^2$) | T (°C.) | Cell Volts | NaOH (Bulk) (Wt. %) | Cathodic Current Efficiency % (C.E.) |
|---|---|---|---|---|---|
| | (276 ASF) | | | | |
| 642 | 30 A/dm$^2$ | 73 | 3.27 | 32.0 | 95 |
| 690 | 30 A/dm$^2$ | 90 | 3.30 | 33.9 | 95 |
| CELL #2 (CONTROL) WITH SINGLE LAYER CATHODE: | | | | | |
| 46 | 304 ASF | 82 | 3.52 | 33.7 | 90 |
| 94 | 304 ASF | 82 | 3.52 | 31.3 | 89 |
| 190 | 304 ASF | 85 | 3.70 | 34.1 | 90 |

It can be seen that the cathodic current efficiency over more than a month, at current densities from 275–300 ASF, ranges as high as the upper 90 percent ranges as compared to 89–90 percent for the control cell. The cell voltages were low while the cell voltages for the single layer cathodes were substantially higher due to the effects of high caustic concentrations on the membrane resistivity, and the higher $H_2$ overvoltage of the carbon.

EXAMPLE 2

A cell #3 was constructed which was identical to cell #1 in Example 1, except that the inner layer of the dual layer cathode attached to the membrane was a bonded aggregate of nickel (rather than carbon) and PTFE binder particles. The composition of the electrode being 8 mg/cm$^2$ of Inco 123 nickel with 15 weight % of DuPont T-30 PTFE. Control cell #4 similar to cell #2 of Example 1 was constructed. The cathode electrode attached to the membrane was a nickel PTFE aggregate identical to the inner layer of the dual layer electrode described above. The cells were operated with the same anolyte and catholytes and the performance of both cells measure. The results were as follows:

TABLE II

| Operating Hours | Current Density (Amps/sq/ft. (ASF) (Amps/sq. decimeter) (A/dm$^2$) | T (°C.) | Cell Volts | NaOH (Bulk) (Wt. %) | Cathodic Current Efficiency % (C.E.) |
|---|---|---|---|---|---|
| CELL #1 WITH DUAL LAYER CATHODE: | | | | | |
| 40 | 304 ASF | 80 | 3.23 | 33.7 | 89 |
| 112 | 30 N dm$^2$ (276 ASF) | 85 | 3.18 | 33.4 | 94 |
| 160 | 30 A/dm$^2$ | 85 | 3.17 | 33.7 | 89 |
| 184 | 30 A/dm$^2$ | 82 | 3.18 | 33.7 | 91 |
| 208 | 30 A/dm$^2$ | 84 | 3.15 | 34.1 | 92 |
| CONTROL CELL: | | | | | |
| 18 | 30 A/dm$^2$ | 81 | 3.51 | 33.0 | 89 |
| 42 | 30 A/dm$^2$ | 84 | 3.50 | 33.0 | 87 |

It can again be seen that the caustic concentrations in excess of 30 wt. %, current efficiencies in excess of 90% at low cell voltages are realized by use of the dual layer cathode attached to the membrane; efficiencies which are better than those realized with a single layer catalytic electrode. It will be appreciated that the novel dual layer electrode is effective in increasing the cathodic current efficiency by moving the electrochemical reaction zone within the electrode away from the interface of the electrode structure with the membrane.

While the invention has been described in connection with certain preferred embodiments thereof, the invention is by no means limited thereto, since modifications in the structures, or the instrumentalities employed or in the steps performed in the process may be made and fall within the scope of the invention. It is contemplated by the appended claims to cover any such modifications that fall within the true spirit and scope of this invention.

What is claimed as new and desired to be secured by U.S. Letters Patent is:

1. A process for generating caustic which comprises electrolyzing a solution between a pair of electrodes separated by a liquid and gas impervious cation exchange membrane at least the side of the membrane at which caustic is produced having a multilayer particulate electrode permanently attached thereto with the particulate layers of the electrode constituting zones of differing overvoltages for the reaction whereby caustic is formed a controlled distance away from the membrane surface.

2. The process according to claim 1 wherein said electrode structure contains a plurality of particulate layers of differing over-voltages for the reaction with the lower over-voltage layer for caustic production being located away from said membrane.

3. The process according to claim 2 wherein the higher over-voltage layer attached to the membrane includes electronically conductive materials.

4. The process according to claim 3 wherein the higher over-voltage layer includes electronically conductive metals.

5. The process according to claim 3 wherein the higher over-voltage layer includes an electronically conductive non-metallic material.

6. A unitary membrane-electrode assembly comprising a permselective liquid and gas impervious ion-exchanging membrane, a particulate electrode structure permanently attached to the surface of the membrane, the particulate layers of said multi-layer structure having different overvoltages for selected electrochemical reactions whereby the distance of the electrochemical reaction zone from the membrane electrode interface is controlled.

7. The unitary membrane-electrode assembly according to claim 6 whereby the particulate layer closer to the membrane has higher over-voltage for the reaction whereby the reaction principally takes place away from the membrane-electrode interface.

8. The unitary membrane-electrode structure according to claim 6 wherein the layer attached to the membrane includes electronically conductive material.

9. The unitary membrane-electrode structure according to claim 8 wherein the layer attached to the membrane includes an electronically conductive metal.

10. A multi layer structure including an electrode element for electrolysis reactions comprising at least two particulate layers including a first gas and liquid permeable, electronically conductive layer, and a gas and liquid permeable electrode layer at which an electrolysis reaction takes place, the said electrode layer having a lower overvoltage for the electrolysis reaction than the said first layer.

11. A multi-layer structure according to claim 10 wherein the permeability of the electrode layer is higher than that of the first layer whereby electrolysis products formed at the lower overvoltage electrode layer flow away from said first layer.

12. A multi-layer structure according to claim 10 wherein said first conductive layer comprises a porous nickel layer and said electrode layer includes a platinum group metal or platinum group metal oxide.

13. The multi-layer structure according to claim 10 wherein said first layer includes a non-metallic conductive carbon or graphite and said electrode layer includes a platinum group metal or platinum group metal oxide.

* * * * *